United States Patent [19]

Anderson et al.

[11] 4,163,998

[45] Aug. 7, 1979

[54] LAMPSHADE HAVING PICTURE DISPLAY WINDOW

[76] Inventors: Robert L. Anderson; Jeannette M. Anderson, both of P.O. Box No. 209, Chesterstown, Md. 21620

[21] Appl. No.: 861,427

[22] Filed: Dec. 16, 1977

[51] Int. Cl.[2] ..... T21V 1/04

[52] U.S. Cl. ..... 362/358; 362/252; 362/351; 362/806

[58] Field of Search ..... 362/252, 351, 353, 355–358, 362/360, 806

[56] References Cited

U.S. PATENT DOCUMENTS

| | | | |
|---|---|---|---|
| 1,335,640 | 3/1920 | Beales | 362/360 |
| 1,463,722 | 7/1923 | O'Boyle | 362/351 X |
| 2,177,204 | 10/1939 | Buzick et al. | 362/351 |
| 2,606,280 | 8/1952 | Stroschein | 362/357 |
| 2,680,317 | 6/1958 | Lewis | 362/357 |
| 2,823,477 | 2/1958 | Willard | 40/131 |
| 2,974,435 | 3/1961 | Eschenroeder | 362/358 |
| 3,456,106 | 7/1969 | Gluschkin | 362/97 |
| 4,079,245 | 3/1978 | Baker | 362/358 X |

*Primary Examiner*—Peter A. Nelson

*Attorney, Agent, or Firm*—Lowe, King, Price & Becker

[57] ABSTRACT

A lampshade is formed with a window opening through which a picture is displayed. The picture is mounted between inner and outer at least partially transparent sheets located against the inner surface of the lampshade, the inner sheet extending slightly below the outer sheet. Only the upper edge of the inner sheet is fastened to the outer sheet and to the lampshade enabling the picture to be inserted between the sheets from below the lampshade. A semi-rigid wire retaining member in the form of a hoop is located inside the lampshade to secure the lower edge of the inner sheet against the outer sheet and retain the picture in position for display through the window opening. The picture is removed by lowering the retaining hoop below the edge of the inner sheet and pulling the picture downwardly from the window.

8 Claims, 6 Drawing Figures

Fig. 1
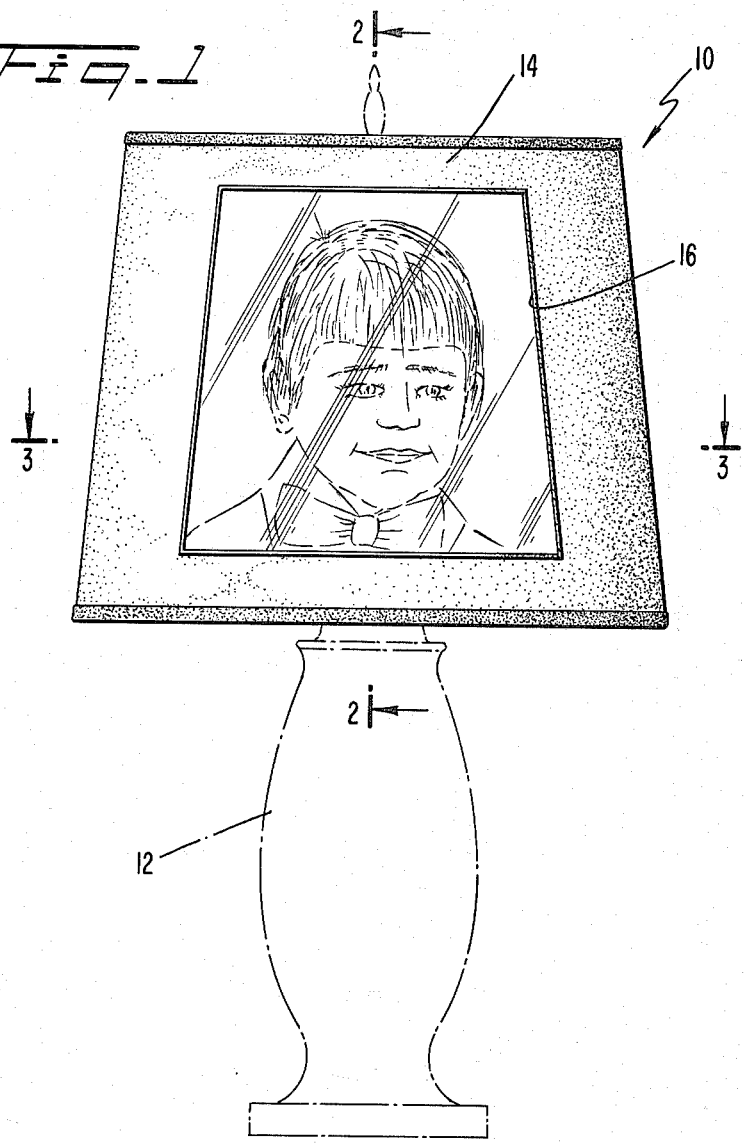
Fig. 2
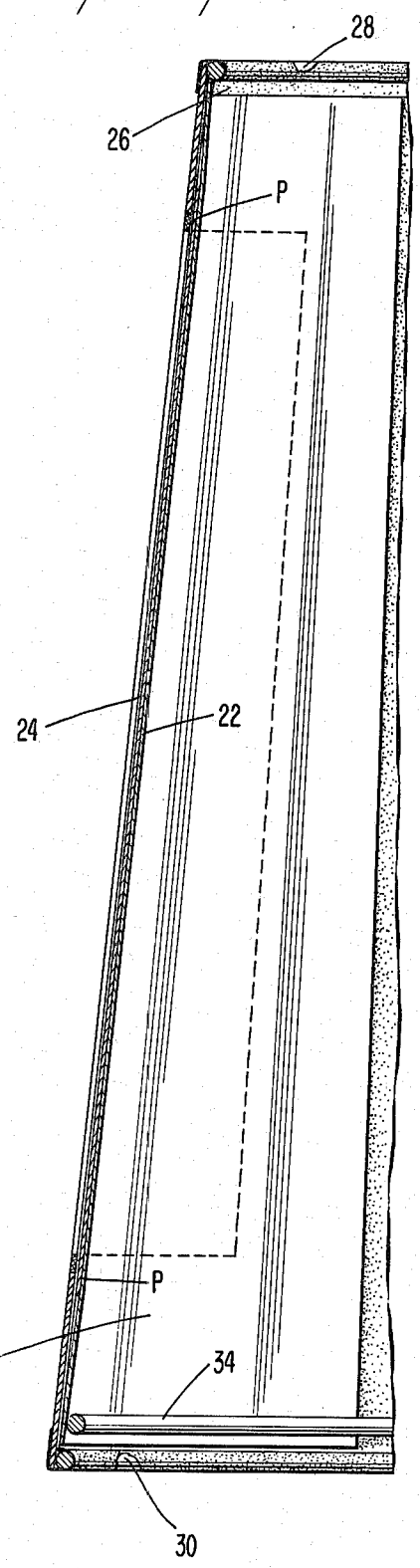
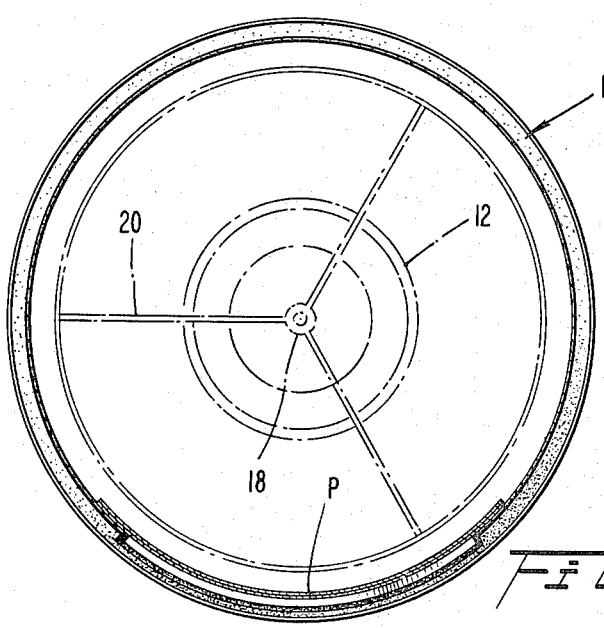
Fig. 3

LAMPSHADE HAVING PICTURE DISPLAY WINDOW

BACKGROUND OF THE INVENTION

The present invention relates generally to decorative lampshades, and more particularly, toward lampshades having window openings for display of ornamental pictures or information.

In the past, lampshades have been provided with panels wherein semi-transparent photographs or advertising materials may be displayed. In most cases, the window portion of the lampshade has been provided with flanges for supporting the picture or with brackets for locking the picture in proper position at the window opening. The picture is illuminated by the incandescent lamp within the lampshade.

Prior picture display lampshades of which I am aware have been limited to the extent that either the picture is formed as an integral part of the shade during construction so that it is impossible to replace the picture, or that removal of the picture is extremely difficult. Furthermore, in those lampshade constructions wherein the picture is removable, the lampshade is relatively expensive and difficult to manufacture.

In some applications, it is necessary to relatively frequently replace the picture being displayed through the lampshade. Assuming that the picture lampshade is being used as a visual aid in connection with advertising, for example, a sales person may display the picture of an item to a customer using the lampshade, and be required to successively change the picture to demonstrate other items in a product line. Thus, the picture must be readily replaceable, preferably from below the lampshade for convenience, and must be securely seated in position at the window opening. Also, in order to maintain a pleasing appearance, all mounting hardware for the picture should be located within the lampshade and invisible from the outside.

Prior art picture lampshades of which I am aware are upon which the present invention is an improvement are: U.S. Pat. No. 824,444 to Schurek; U.S. Pat. No. 1,171,031 to Fisher; U.S. Pat. No. 1,463,722 to O'Boyle; U.S. Pat. No. 1,593,305 Kulka; U.S. Pat. No. 2,177,204 to Buzick et al.; U.S. Pat. No. 2,680,137 to Lewis; U.S. Pat. No. 2,823,477 to Willard; U.S. Pat. No. 2,974,435 to Eschenroeder; and U.S. Pat. No. 3,456,106 to Gluschkin.

One object of the invention, accordingly, is to provide a new and improved picture lampshade, wherein the picture is easily replaceable.

Another object of the invention is to provide a new and improved picture lampshade having no visible picture mounting hardware.

Another object of the invention is to provide a new and improved picture lampshade that has a pleasing appearance and is easy and economical to manufacture.

SUMMARY OF THE INVENTION

A picture lampshade, in accordance with the invention, is provided with inner and outer at least partially transparent sheets positioned behind a window opening formed in the lampshade. The inner sheet is fastened to the outer sheet and to the lampshade along only the upper edge of the sheet, the lower edge being free to receive the picture to be displayed. A semi-rigid wire retaining hoop having a diameter corresponding to the diameter of the lower end of the lampshade is located against the inner surface of the lampshade in contact with the inner sheet. The hoop locks or secures the lower edge of the inner sheet against the outer sheet to retain the picture in position for display through the window opening.

The lower edge of the inner sheet may extend slightly above the lower edge of the outer sheet. The retaining hoop is locatable within the lampshade in an upper position in contact with the inner sheet for retaining the picture, and in a lower position below the inner sheet to permit removal or insertion of the picture from beneath the lampshade. Therefore, the picture can be replaced by simply manually shifting the retaining hoop within the lampshade between the locked and unlocked positions.

Still other objects, advantages and features of the present invention will become readily apparent to those skilled in this art from the following detailed description, wherein I have shown and described only the preferred embodiment of the invention, simply by way of illustration of the best modes contemplated by me of carrying out my invention. As will be realized, the invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWING

FIG. 1 is a front view of the picture lampshade, in accordance with the present invention, mounted on a lamp;

FIG. 2 is a cross sectional side view of a portion of a lamp taken along the line 2—2 in FIG. 1;

FIG. 3 is a cross sectional top view of the lampshade taken along the line 3—3 in FIG. 1;

DETAILED DESCRIPTION OF THE PREFERRED EMBODIMENT

Figure 4:
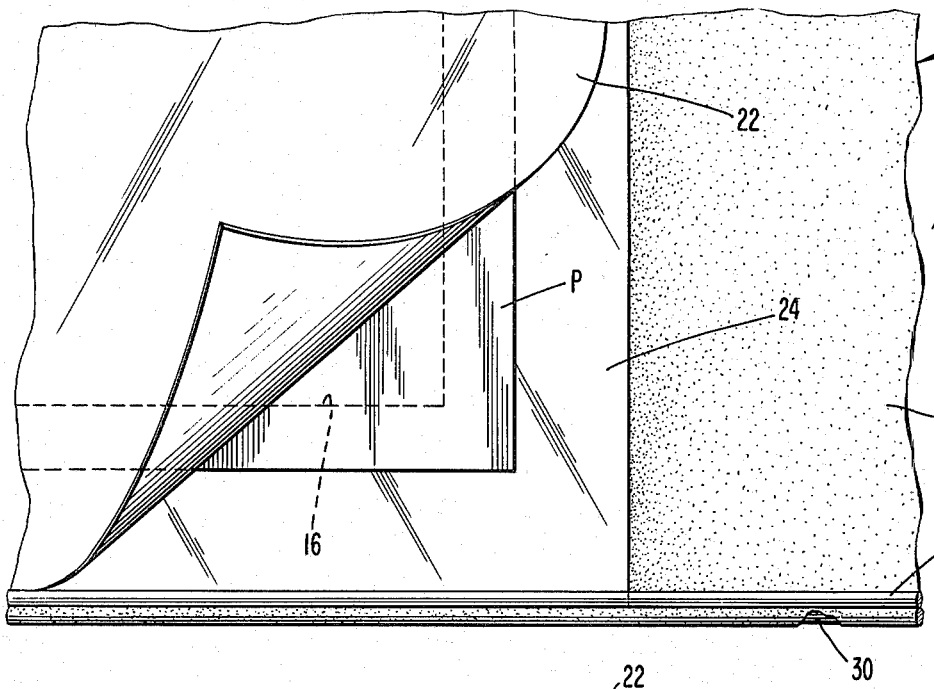
FIG. 4 is a view of a portion of the inner surface of the lampshade showing the retaining hoop in a lower, unlocked position for removal or insertion of a picture.

Referring to FIG. 1, lampshade 10, mounted on a conventional lamp base 12, is generally frustoconical and has an opaque body 14 that is formed with a cut-out portion 16 defining a picture display window. The picture display window 16 is adapted to display ornamental prints, photographs, advertisements or other information, all represented herein by the term "picture". The lampshade 10 is mounted to a lamp base 12 by a central support ring 18 and radially extending spokes 20, in a conventional manner (see FIG. 3).

Located within the lampshade 10 and in contact with the inner surface thereof behind window opening 16 are an inner sheet 22 and an outer sheet 24. Sheets 22 and 24 are preferably translucent in order to create a "softness" in the picture being displayed, however, one or both of the sheets may be transparent, if desired. I have found that best results are provided by forming both surfaces of the inner sheet 22 and only the outer surface of outer sheet 24 with a gloss. Sheet 22 is fastened to sheet 24 and to the lampshade 10 at the upper edge of sheet 22 at an adhesive flap or tape 26 located beneath the upper frame wire 28. The lower and side edges of sheet 22 remain open to receive a picture P from beneath the lampshade, and to permit adjustment of the picture in the opening 16.

Figure 6:
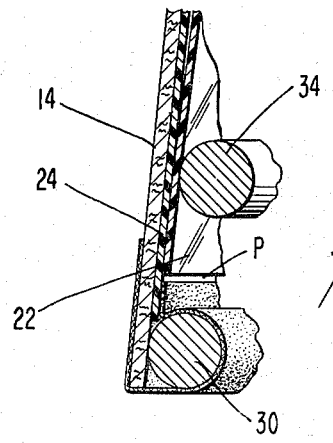
FIG. 6 is a cross sectional view along the line 6—6 in FIG. 5 showing the retaining hoop and standard frame wire in the picture lampshade of the present invention.

Outer sheet 24 extends downwardly to lower frame wire 30 at the lower end of the lampshade 10. The sheet 24 may, if desired, be secured in position at lower frame wire 30 by an adhesive or the like. The inner sheet 22, however, may not extend to the lower frame wire 30, the lower edge of the inner sheet being spaced slightly above the frame wire as best shown in FIG. 6.

A retaining wire or hoop 34, having a diameter corresponding to the diameter of the lower end region of the lampshade 10, is positioned inside the lampshade, as shown in FIG. 2, to seal or lock the lower edge of inner sheet 22 against outer sheet 24 and thereby retain picture P in place behind window opening 16. Retaining hoop 34 is formed of a semi-rigid, continuous piece of wire that applies a constant outward force against the sheets 22,24 on the inner surface of the lampshade 10. This force helps to maintain the shape of the lampshade as well as to retain the picture P. The retaining hoop 34 thus supplements the standard frame wire 30 and provides an exceptionally sturdy lower end structure of the lampshade 10.

Figure 5:
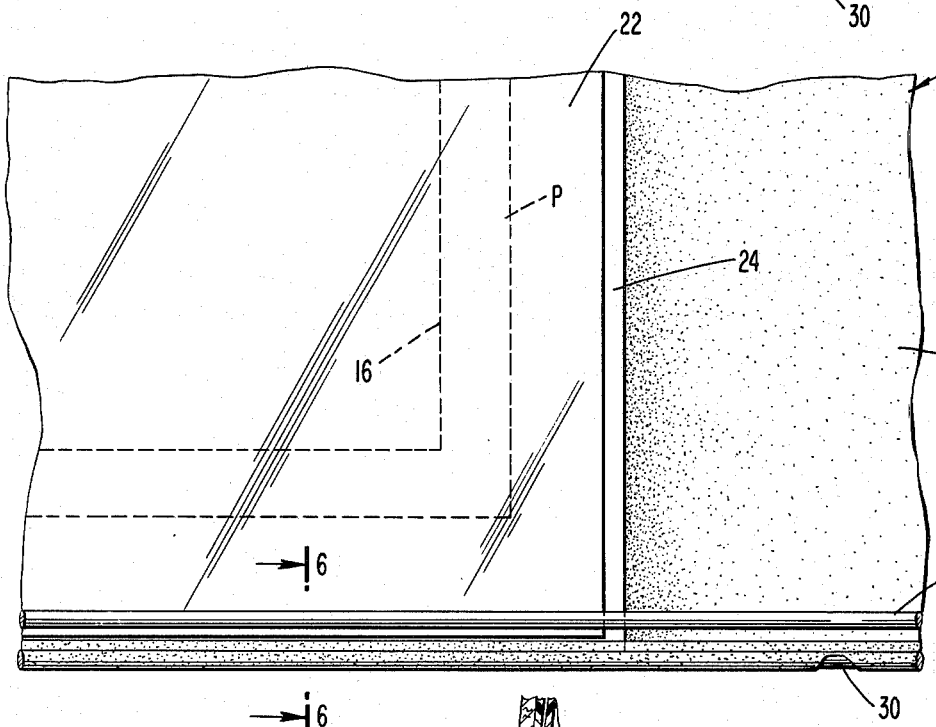
FIG. 5 is similar to FIG. 4, wherein the retaining hoop is in an upper, locked position.

With retaining hoop 34 positioned downwardly within lampshade 10 as shown in FIG. 4, whereby the retaining hoop 34 is seated on or just above frame wire 30, the hoop 34 does not overlap the lower edge of the inner sheet 22. This permits the sheet 22 to be folded inwardly for insertion or removal of picture P at window opening 16. Retaining hoop 34 is manually shifted upwardly, on the other hand, as shown in FIGS. 5 and 6, to cause the retaining hoop 34 to be in contact with the lower edge region of inner sheet 22, and retain the picture P between the sheets 22 and 24.

Thus, in use, in order to replace the picture P within the window 16 of lampshade 10, the user merely reaches into the lampshade 10 from below, lowers retaining loop 34 to release the inner sheet 22 and then replaces picture P. The picture P is now secured in place by raising the hoop 34 to lock the lower edge of sheet 22.

As can be appreciated in FIGS. 1 and 2, the lampshade 10 provides a very simple structure that is pleasing in appearance and has a minimum number of operating parts. Special picture holding brackets are not needed since locking and unlocking of the picture is provided by the retaining hoop 34 which itself is invisible from the outside of the lampshade. The opaque body 14 of the lampshade 10, together with the translucent screens 22 and 24, through which lamp light passes provides the necessary contrast to emphasize the picture or other material being displayed.

In this disclosure there is shown and described only the preferred embodiment of the invention, but, as aforementioned, it is to be understood that the invention is capable of use in other and different combinations and environments, and is capable of changes or modifications within the scope of the inventive concept as expressed herein. For example, sheet 22 may, if desired, extend downwardly within the lampshade 10 to the upper part of frame wire 30. The retaining hoop 34 would thus be removed to release the sheet 22 by manually deforming the hoop inwardly to swing the hoop over the frame wire 30 for removal from below. Alternatively, the retaining hoop 34 may be pressed upwardly along the inner surface of the lampshade toward the upper edge of sheet 22 to release this sheet for removal or replacement of the picture.

What is claimed is:

1. A lampshade assembly having a window opening formed therein, an inner at least partially transparent sheet located within said lampshade at said opening, said sheet being secured to said lampshade along only an upper marginal portion of said sheet and forming a carrier for a picture to be displayed through the window opening, a lower marginal portion of said inner sheet being separable from said lampshade to receive the picture to be displayed, and a semi-rigid wire, picture retaining member having a configuration conforming to a horizontal cross section of the lampshade; said retaining member being removably located within said lampshade and biased radially outwardly into contact with the inner surface of the lower, marginal portion of said inner sheet to maintain said inner sheet in contact with said lampshade and thereby retain the picture in position for display through said window opening.

2. The lampshade assembly of claim 1, including an outer sheet having an upper edge thereof secured to the lampshade, said picture being supported between said inner and outer sheets.

3. The lampshade as defined in claim 2, wherein said retaining member is located in a first position in contact with a lower marginal portion of said inner sheet to retain the picture between said sheets, and in a second position out of contact with said inner sheet to release said picture for removal.

4. The lampshade as defined in claim 3, wherein the lower edge of said inner sheet is disposed above the lower end of said lampshade, the retaining member being located beneath said lower edge in said second position.

5. The lampshade as defined in claim 4, including a frame wire secured at the lower end of said lampshade, the retaining member being seated on said frame wire in said second position.

6. The lampshade as defined in claim 5, wherein said lampshade has a circular horizontal cross section, and said retaining member is a wire hoop.

7. The lampshade as defined in claim 6, wherein both surfaces of said inner sheet are glossed, and only the outer surface of said outer sheet is glossed.

8. A picture lampshade assembly, comprising a lampshade body through which a picture is displayed; picture carrier means for positioning the picture for display at the inner surface of said lampshade body, a flap located along an upper end of said body, an upper edge of said picture carrier being retained in said flap, and a semi-rigid, removable retaining wire having a configuration corresponding to a horizontal cross section of said lampshade body for retaining a lower marginal portion of the picture carrier, said retaining wire being removably located within said lampshade body and biased radially outwardly into contact with the inner surface of the lower marginal portion of said picture carrier.

* * * * *